US005615833A

United States Patent [19]

Robillard et al.

[11] Patent Number: 5,615,833

[45] Date of Patent: Apr. 1, 1997

[54] EXTERNAL MIXING TYPE BURNER

[75] Inventors: Dominique Robillard, Versailles; Michel Inizan, Clayes Sous Bois, both of France

[73] Assignee: L'Air Liquide, Societe Anonyme pour l'Etude et l'Exploitation des Procedes Georges Claude, Paris, France

[21] Appl. No.: 575,753

[22] Filed: Dec. 20, 1995

[30] Foreign Application Priority Data

Dec. 21, 1994 [FR] France ..... 94 15412

[51] Int. Cl.[6] ..... B05B 15/00

[52] U.S. Cl. ..... 239/132.3; 239/424.5

[58] Field of Search ..... 431/158, 160; 239/132.3, 132.1, 424.5

[56] References Cited

U.S. PATENT DOCUMENTS

| | | | |
|---|---|---|---|
| 3,480,376 | 11/1969 | Lyman | 239/132.3 |
| 3,545,903 | 12/1970 | McCullough | 431/160 |
| 3,685,740 | 8/1972 | Shepherd | 239/132.3 |
| 5,161,379 | 11/1992 | Jones et al. . | |

FOREIGN PATENT DOCUMENTS

| | | |
|---|---|---|
| 0069245 | 1/1983 | European Pat. Off. . |
| 2183816 | 6/1987 | United Kingdom . |
| 2197714 | 5/1988 | United Kingdom . |

*Primary Examiner*—Carroll B. Dority
*Attorney, Agent, or Firm*—Burns, Doane, Swecker & Mathis, LLP

[57] ABSTRACT

Provided is a burner with external mixing which comprises, just below a drilled plate forming the nozzle, a homogenization chamber in which one of the components of the flame penetrates radially via orifices. The other component feeding the flame passes through the chamber via a series of axial tubes running out onto the front face of the drilled plate where the mixing of the components occur. The burner has application especially to the incineration of industrial waste with oxygen.

9 Claims, 1 Drawing Sheet

FIG.:1
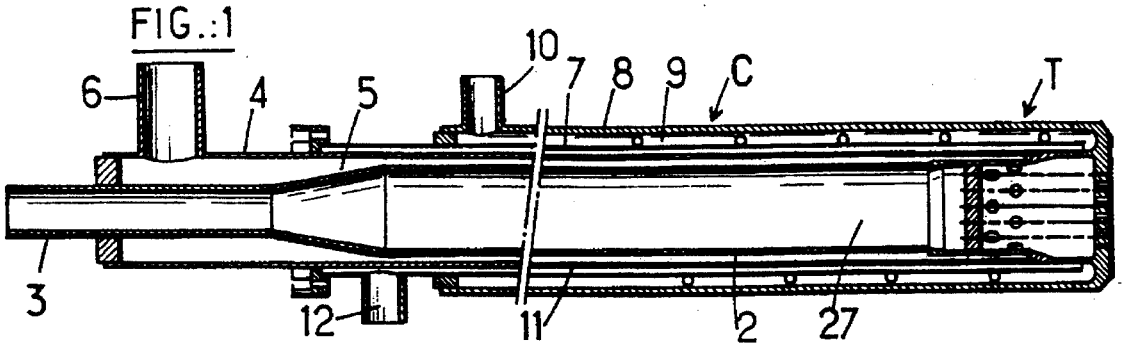
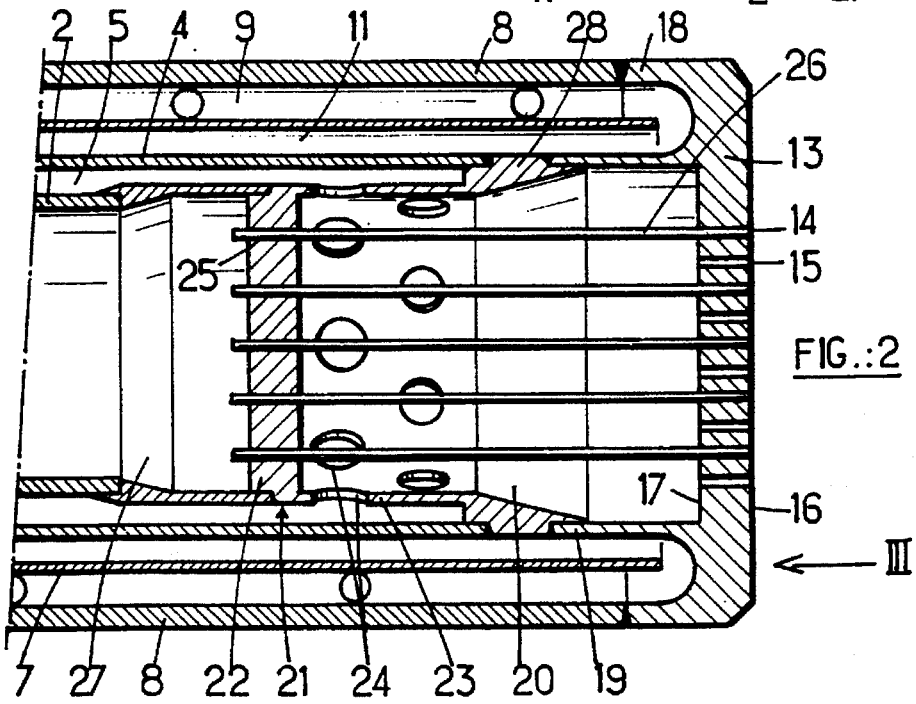
FIG.:2
FIG.:3
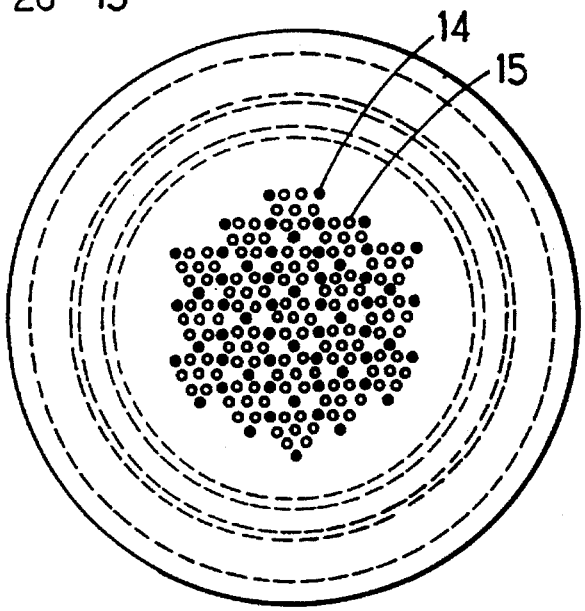

EXTERNAL MIXING TYPE BURNER

BACKGROUND OF THE INVENTION

The present invention relates to a burner of the external mixing type. In particular the present invention relates to a burner exhibiting excellent flame stability.

The treatment of some industrial waste by incineration in oxygen is currently regarded as a very promising operation. The waste, in the form of a gas, a liquid or a foam, possibly containing suitable additives, is sent into a burner fed with pure oxygen or a gas with at least a high oxygen content.

For example, a process is known which has been developed for treating certain aqueous effluents coming from the flushing of steam generators of nuclear power stations, but which may also have many other applications. This process comprises dispersing the waste to be incinerated in an aqueous solution containing a surfactant and, where appropriate, a fuel, converting this solution into a slightly pressurized foam and transferring this foam into a cyclone furnace where it is passed through an oxygen burner.

The advantages of using oxygen in a burner are well known, among which are the possibility of obtaining high temperatures, good retention of the flame at the nozzle of the burner, even for low calorific values, a decrease in the volume of flue gases and, consequently, in the overall size of the plant, and a reduction in the product ion of nitrogen oxides.

In order to limit the drawbacks resulting from the variations in composition of the material to be treated, which is the general rule in the case of waste, it is preferable to use a burner having external mixing. However, studies have shown that the currently available burners of this type do not allow sufficient flame stability to be achieved in the case of large variations in the material to be treated.

SUMMARY OF THE INVENTION

Accordingly, an object of the present invention is to provide a burner having improved performance compared to devices of the prior art, with the burner being able to produce a homogeneous flame at a short and substantially constant distance from the nozzle of the burner, despite the variations in the fuel. While the burner would have particular application in the field of waste incineration, however, it goes without saying that the burner of the invention can be used in all fields.

In order to achieve the foregoing objective, the invention provides a burner of the external mixing type, including a nozzle drilled with a passage for supplying a first fluid and with a passage for supplying a second fluid capable of forming a flame when it is in contact with the first fluid. The burner operates by forming the flame at a short distance from the nozzle, with the burner having as a particular feature a nozzle which comprises a piece having an external face drilled with holes, with some of these holes running into a chamber fed with the first fluid. The chamber is delimited by the nozzle, a sidewall drilled with orifices for the intake of the first fluid, and an end wall transverse to the sidewall, with the sidewall being in sealed connection with the nozzle and with the end wall. The nozzle contains some other holes each connected to a tube, which is fixed to the nozzle in a sealed manner and which passes through the end wall also in a sealed manner, in order to run into a conduit for supplying the second fluid. The set of holes running into the chamber and the set of holes connected to the tubes each have a regular and uniform distribution over the external face of the nozzle.

The presence of a chamber, in which the flux of the first fluid is homogenized, ensures that the latter emerges at the external face of the burner with a substantially constant flow rate, irrespective of the position of the hole. The same applies for the second fluid. Thus a uniformly distributed set of jets for the first fluid and for the second fluid is produced, guaranteeing uniform combustion.

This result is best achieved if the external face of the nozzle is planar and/or the holes are parallel, especially when these two particular features are combined. The first fluid may be the fuel, in the form of foam or gas or liquid, and the second fluid may be oxygen. However, the reverse situation is possible. The respective number and diameters of the holes running into the chamber and of the tubes obviously depend on, the desired combustion and especially on the nature of the fuel and of the oxidizing agent.

BRIEF DESCRIPTION OF THE FIGURES OF THE DRAWING

FIG. 1 is an axial section of an entire burner according to the invention;

FIG. 2 is an enlarged view of part of FIG. 1, relating to the head of the burner; and FIG. 3 is a front view of the burner taken along the arrow III in FIG. 2.

DETAILED DESCRIPTION OF THE PREFERRED EMBODIMENTS

Referring to the figures in the drawing, the burner, in its entirety, comprises a tubular body C seen in FIG. 1, and a head T as seen in more detail in FIGS. 2 and 3.

The body C comprises a plurality of concentric tubes, namely, starting from the axis, a first tube 2 which is connected to an oxygen inlet 3 and which, on the opposite side, terminates in the head T. A second tube 4 delimits, with the tube 2, an annular conduit 5 which serves to supply the fuel from a fuel inlet 6 to the head T. Concentric third and fourth tubes 7, 8 define between them two annular spaces intended for the flow of a coolant which penetrates into the external annular space 9 via an inlet 10 and emerges from the internal annular space 11 via an outlet 12. The two annular spaces 9 and 11 communicate with each other in the head T of the burner.

The burner head comprises a piece called the "nozzle" which has the overall shape of a disk 13 which is drilled, in its central part, with a multitude of orifices 14, 15. The external face 16 of the nozzle 13 is planar, while its opposite face 17 supports an external first projection 18, intended to be connected to the external tube 8, and another annular projection 19 which serves to delimit, with the face 17, a chamber 20. A plugging piece 21 has the general shape of a cylinder open at one end and closed at the other end by a drilled disk 22. The cylindrical part 23 of the piece 21 is welded at its ends to the cylindrical projection 19 of the nozzle. A few radial orifices 24, arranged in two radial planes, are provided in the cylindrical part 23, a short distance from the disk 22.

The drilled holes 14 and 15 in the burner nozzle 13 all run out into the chamber 20. FIG. 3 shows their uniform distribution. A few of the holes 14 are in axial alignment with drilled holes 25 in the plugging piece 21 and a tube 26 is crimped into each hole 14 and each corresponding hole 25. All the holes 25 in the disk 22 are connected to a corresponding hole 14 in the nozzle so that there is no communication between the chamber 20 and the space 27 which lies on the opposite face of the disk 22 and which extends the oxygen intake conduit. FIG. 3 shows, as solid circles, the drilled holes 14 which are provided with tubes 26 and which therefore communicate with the drill holes 25 and with the space 27 and, as open circles, the tubes 15 which communicate with the chamber 20. It may be seen that the drill holes 14 and the drill holes 15 are distributed uniformly. The ratio of the number of drill holes 14 to the number of drill holes 15 is obviously designed according to the problem involved.

The end of the tube 4 is welded to an external shoulder 28 on the cylindrical wall 23 of the plugging piece 21. This shoulder is closer to the external face of the nozzle than the orifices 24. The fuel therefore penetrates into the chamber 20 radially. The fuel streams leaving the orifices 24 strike the tubes 26 before leaving via the orifices 15 in the nozzle. This results in mixing which ensures that the flow rates through each of the orifices 15 are the same. The chamber 20 also constitutes a buffer chamber which homogenizes the variations in composition of the fuel.

The conduits 26 and the holes 14 convey the oxygen directly from the space 27, without bringing it into contact with the fuel in the chamber 20. Here too, the distribution of holes 14 is designed to ensure uniform distribution.

The structure of the burner also makes it possible to produce a particularly homogeneous and constant flame.

The double-walled cooling circuit 9, 11 is extended virtually as far as the disk 13. It therefore ends up closer to the external face 16 of the nozzle than the weld joining the shoulder 28 to the tube 4. This weld is therefore cooled effectively, which guarantees that it will last.

We claim:

1. A burner of the external mixing type, comprising a nozzle including conduit means for supplying a first fluid and conduit means for supplying a second fluid capable of forming a flame when it is in contact with the first fluid, the burner operating by forming the flame at a short distance from the nozzle, with the nozzle comprising:

a piece having an external face drilled with holes, some of the holes running into a chamber fed with the first fluid, the chamber being delimited by the nozzle external face, an annular sidewall drilled with orifices spaced around the annular sidewall and in communication with the conduit means for the first fluid for the intake of the first fluid into the chamber where mixing occurs, and an end wall transverse to the sidewall, the sidewall being in sealed connection with the nozzle piece and with the end wall, and some other holes in the nozzle each connected to a respective one of a plurality of tubes which are fixed to the nozzle external face in a sealed manner and which pass through the end wall also in a sealed manner, in order to run into a conduit for supplying the second fluid, the set of holes running into the chamber and the set of holes connected to the tubes each having a regular and uniform distribution over the external face of the nozzle.

2. The burner as claimed in claim 1, wherein the external face of the nozzle is approximately planar.

3. The burner as claimed in claim 1, wherein the holes running into the chamber and connected to the tubes are parallel.

4. The burner as claimed in claim 3, wherein the external face of the nozzle is planar.

5. A burner of the external mixing type comprising a nozzle including conduit means for supplying a first fluid and conduit means for supplying a second fluid capable of forming a flame when it is in contact with the first fluid, the burner operating by forming the flame at a short distance from the nozzle, with the nozzle comprising:

a piece having an external face drilled with holes, some of the holes running into a chamber fed with the first fluid, the chamber being delimited by the nozzle external face, a sidewall drilled with orifices in communication with the conduit means for the intake of the first fluid, and an end wall transverse to the sidewall, the sidewall being in sealed connection with the nozzle piece and with the end wall, and some other holes in the nozzle external face each connected to a respective one of a plurality of tubes which are fixed to the nozzle external face in a sealed manner and which pass through the end wall also in a sealed manner, in order to run into said conduit means for supplying the second fluid, the set of holes running into the chamber and the set of holes connected to the tubes each having a regular and uniform distribution over the external face of the nozzle wherein the piece is comprised of a substantially planar plate drilled with said holes in its central part and having on its side opposite its external face a cylindrical projection which surrounds the set of holes and forms a part of the sidewall of the chamber.

6. The burner as claimed in claim 2 wherein the piece having an external face is formed as a planar plate which supports a cylindrical extension which forms at least part of the sidewall of the chamber.

7. A burner of the external mixing type comprising a nozzle including conduit means for supplying a first fluid and conduit means for supplying a second fluid capable of forming a flame when it is in contact with the first fluid, the burner operating by forming the flame at a short distance from the nozzle, with the nozzle comprising:

a piece having an external face drilled with holes, some of the holes running into a chamber fed with the first fluid, the chamber being delimited by the nozzle external face, a sidewall drilled with orifaces and in communication with the conduit means for the first fluid for the intake of the first fluid, and an end wall transverse to the sidewall, the sidewall being in sealed connection with the nozzle piece and with the end wall, and some other holes in the nozzle external face each connected to a respective one of a plurality of tubes which are fixed to the nozzle in a sealed manner and which pass through the end wall also in a sealed manner, in order to run into said conduit means for supplying the the second fluid, the set of holes running into the chamber and the set of holes connected to the tubes each having a regular and uniform distribution over the external face of the nozzle, wherein the conduit for supplying the second fluid comprises a first tube welded to the end wall and a second tube, coaxial with the first tube and of a larger diameter, being welded to an external shoulder of the wall of the chamber, this shoulder being closer to the external face of the nozzle than the orifices for intake of the first fluid, whereby said first fluid reaches these orifices by passing through said conduit means for said second fluid and which is formed by an annular space lying between the first and the second tubes.

8. The burner as claimed in claim 1, wherein the burner including conduit means in which a coolant passes, this coolant cooling not only the nozzle but also a shoulder of the wall of the chamber.

9. The burner as claimed in claim 1, wherein the tubes are fixed to the nozzle holes by crimping.

* * * * *